US006926009B1

(12) United States Patent
Woelber et al.

(10) Patent No.: US 6,926,009 B1
(45) Date of Patent: Aug. 9, 2005

(54) ASHTRAY MECHANISM

(76) Inventors: Korey Woelber, 3127 Johnson Ave., Boyden, IA (US) 51234; William Woelber, 3127 Johnson Ave., Boyden, IA (US) 51234

( * ) Notice: Subject to any disclaimer, the term of this patent is extended or adjusted under 35 U.S.C. 154(b) by 358 days.

(21) Appl. No.: 10/378,150

(22) Filed: Mar. 4, 2003

(51) Int. Cl.[7] ..... A24F 13/08
(52) U.S. Cl. ..... 131/242; 131/231; 131/240.1; 131/238; 131/241
(58) Field of Search ..... 131/231, 240.1, 131/238, 241, 242; 296/37.9, 37.11

(56) References Cited

U.S. PATENT DOCUMENTS 1,554,660 A * 9/1925 Ruskay ..... 220/576
1,573,870 A * 2/1926 Sanford ..... 296/37.11
2,595,103 A 4/1952 Schmaling, Sr.
2,851,156 A 9/1958 Thompson
3,084,789 A * 4/1963 Kirby ..... 296/37.9
3,095,108 A * 6/1963 McKenzie ..... 220/502
3,500,492 A 3/1970 Coleman
3,561,452 A * 2/1971 Artelli ..... 131/235.1
3,840,027 A 10/1974 Patterson
4,548,217 A 10/1985 Saculla
4,993,435 A 2/1991 McCann
5,224,499 A 7/1993 Zayas
5,662,130 A * 9/1997 Wiltshire ..... 132/323

* cited by examiner

*Primary Examiner*—Steven P. Griffin
*Assistant Examiner*—Carmen Lyles-Irving
(74) *Attorney, Agent, or Firm*—Donald R. Schoonover

(57) ABSTRACT

An ashtray includes doors that open and close and define a disposal path to a drawer when open. Cigarettes dropped on the doors will fall into the drawer when the doors are open. Cigarette disposal openings lead to the drawer and a cigarette grinder mechanism can be included to grind the cigarette or to cut off the lit tip of a cigarette placed in the cigarette disposal opening. Debris from the ground or cut cigarette drops into the drawer.

2 Claims, 2 Drawing Sheets

ASHTRAY MECHANISM

BACKGROUND OF THE INVENTION

1. Field of the Invention

The present invention relates to the general art of containers, and to the particular field of ashtrays.

2. Discussion of the Related Art

Residue associated with cigarette smoking has long been a problem. Simple ashtrays in which cigarette ash is deposited and snuffed cigarette butts are left have been a source of problems. Not only are such ashtrays unsightly and unpalatable, they are often a source of smoldering cigarettes. Smoldering cigarettes not only produce undesirable smoke, they can be potential fire hazards.

Therefore, the art contains several designs for cigarette disposal units which capture the cigarette. However, while effective, these known units often do not fully seal off the discarded cigarette thereby allowing smoke to escape and permitting air to reach a discarded cigarette which may permit the cigarette to smolder.

Therefore, there is a need for an ashtray that ensures that a discarded cigarette is fully extinguished, and is not permitted to smolder.

Cleaning ashtrays has always been an undesirable task. Thus, anything that can be done to make this job easier and more effective is desirable.

Therefore, there is a need for making the task of cleaning an ashtray easier and more effective.

PRINCIPAL OBJECTS OF THE INVENTION

It is a main object of the present invention to provide an ashtray that ensures that a discarded cigarette is fully extinguished, and is not permitted to smolder.

It is another object of the present invention to provide an ashtray that is easily and effectively cleaned.

SUMMARY OF THE INVENTION

These, and other, objects are achieved by an ashtray mechanism which comprises a housing having a top wall having a cigarette disposal opening defined therein, a side wall and an internal volume defined between the top wall and the side wall; a drawer slidably mounted on the side wall to move into and out of the internal volume of the housing, the drawer being in a closed position when the drawer is located inside the internal volume and being in an open position when at least some of the drawer is located outside of the internal volume; a plurality of cigarette disposal openings defined through the top wall of the housing and located above the drawer when the drawer is in the closed position; a door unit attached to the top wall of the housing adjacent to the cigarette disposal opening and including two doors which are movable relative to each other between an open orientation defining a cigarette disposal path between the cigarette disposal opening in the top wall of the housing and the drawer when the drawer is in the closed position; and a door-operating mechanism operatively connected to the door unit to move the doors of the door unit between the closed position and the open position, the door-operating mechanism including a button located on the top wall of the housing.

The ashtray embodying the present invention ensures that discarded cigarettes are closed off from the environment thus helping to ensure that the discarded cigarette is completely extinguished. Smoke from this source is thus reduced if not eliminated. Still further, the ashtray embodying the present invention can grind all or a portion of a discarded cigarette to further ensure that the cigarette is fully extinguished.

BRIEF DESCRIPTION OF THE DRAWING FIGURES

DETAILED DESCRIPTION OF THE PREFERRED EMBODIMENT

Figure 2:
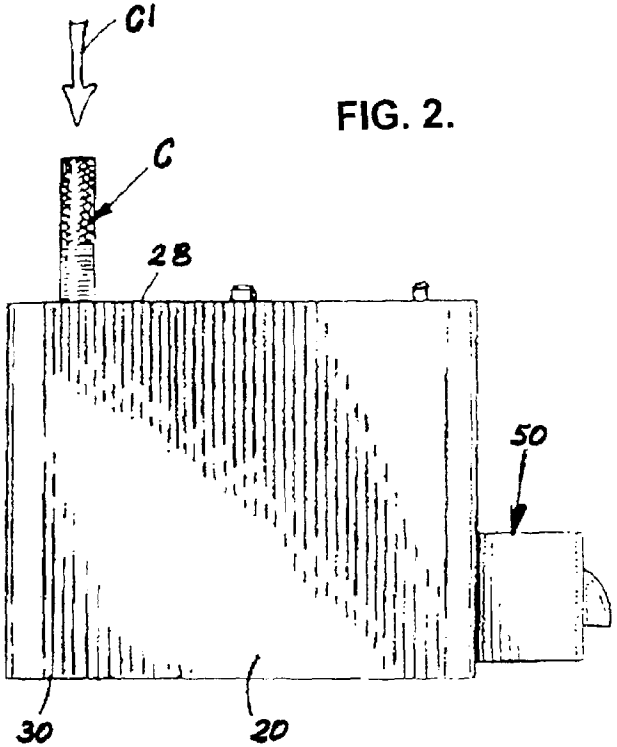
FIG. 2 is an end elevational view of the ashtray embodying the present invention.

Other objects, features and advantages of the invention will become apparent from a consideration of the following detailed description and the accompanying drawings.

Referring to the figures, it can be seen that the present invention is embodied in an ashtray mechanism 10 that will efficiently dispose of cigarette ash as well as cigarette butts and prevent smoldering of discarded cigarettes. Mechanism 10 comprises a housing 12 having a first side wall 14, a second side wall 16, a first end wall 18, a second end wall 20, and a longitudinal axis 22 extending between the first end wall 18 and the second end wall 20. A transverse axis 24 extends between the first side wall 14 and the second side wall 16. A top wall 28 is located on a top rim of each of the side walls 14, 16 and end walls 18, 20 and a bottom wall 30 is attached to a bottom rim of the end walls 18, 20 and side walls 14, 16. A height dimension 32 extends between the top wall 28 and the bottom wall 30. A disposal opening 34 is defined through the top wall 28 and an internal wall 36 has an upper rim 38 attached to the top wall 28 adjacent to the disposal opening 34. The internal wall 36 extends toward the bottom wall 30 and has a lower end 40 spaced apart from the top wall 28 and from the first side wall 14 and from the second side wall 16 and from the first end wall 18 and from the second end wall 20 and from the bottom wall 30. The housing 12 has an internal volume 42 defined by the top wall 28 and the first side wall 14 and the second side wall 16 and the first end wall 18 and the second end wall 20 and the bottom wall 30. A drawer slot 44 is defined in the first side wall 14.

Figure 1:
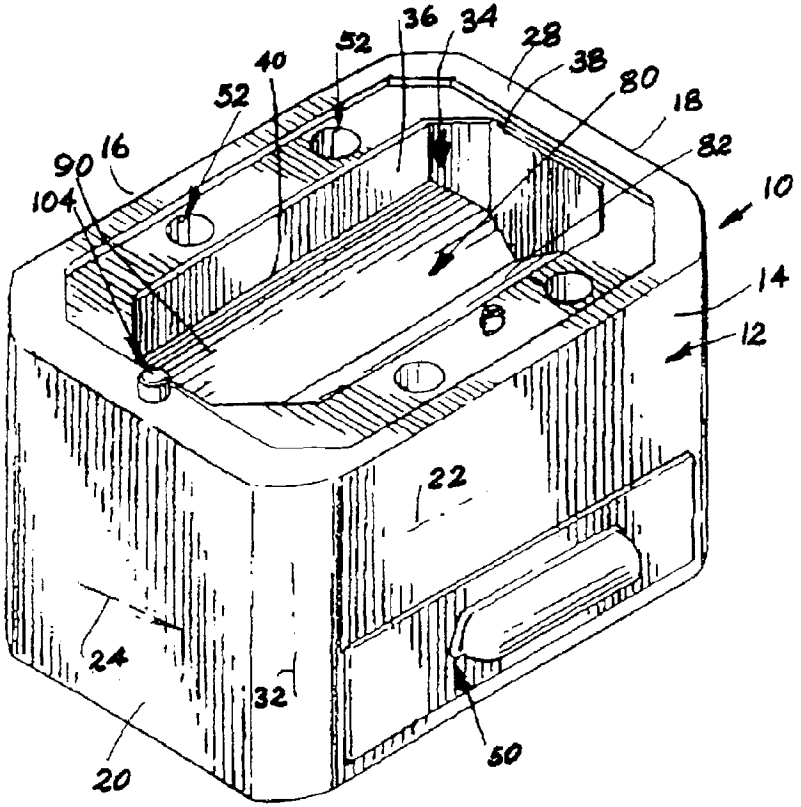
FIG. 1 is a perspective view showing the ashtray embodying the present invention.
Figure 3:
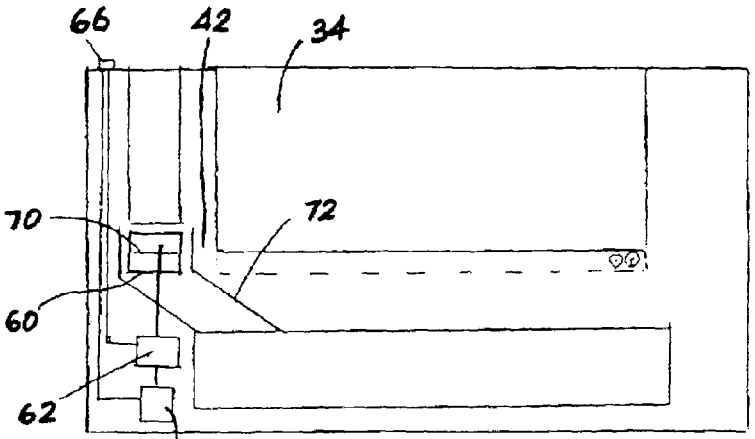
FIG. 3 is a schematic representation of an elevational view showing a grinding mechanism in the ashtray of the present invention.

A drawer 50 is slidably mounted on the first side wall 14 of the housing 12 to move between a closed position shown in FIG. 1 located beneath the disposal opening 34 of the housing 12 and an open position shown in FIG. 2 at least partially located outside of the internal volume 42 of the housing 12. The drawer 50 can be removed from the housing 12 and is used to store ashes and cigarette butts.

A plurality of cigarette disposal openings, such as opening 52, are defined through the top wall 28 of the housing 12 and are located above drawer 50 when the drawer 50 is in the closed position. Cigarettes, such as cigarette C, are forced into the cigarette disposal openings 52 in direction C1 with the lit end leading the way. The cigarettes can be accommodated in the drawer 50, or ground up or simply cut as will be understood from the following discussion.

A cigarette grinder mechanism 60 is associated with at least one cigarette disposal opening of the plurality of cigarette disposal openings 52. The cigarette grinder mechanism 60 includes a motor 62 mounted on the housing 12 inside the internal volume 42 of the housing 12, a power source 64, such as a battery or a connection to an external power source, located inside the internal volume 42 of the housing 12, and a switch 66 mounted on the top wall 28 of the housing 12. The switch 66 has an "on" configuration and an "off" configuration and electrically connects the motor 62 to the power source 64 when the switch 66 is in the "on" configuration. The cigarette grinder mechanism 60 further includes a grinder blade 70 connected to the motor 62 and located adjacent to the one cigarette disposal opening 34 to engage a cigarette located in that cigarette disposal opening 34 and to grind the cigarette located in that cigarette disposal opening 34 when the motor 62 is electrically connected to the power source 64. The cigarette grinder mechanism 60 further includes a debris chute 72 connecting the grinder blade 70 to the drawer 50 when the drawer 50 is in the closed position. Debris from a ground cigarette will fall into the chute 72 and be directed to the drawer 50 for storage until the drawer 50 is removed for disposal of the debris.

A door unit 80 is attached to the top wall 28 of the housing 12 adjacent to the disposal opening in the top wall 28 of the housing 12 and includes a first door 82 having a first end 84 hingeably connected to the lower end 40 of the internal wall 36 of the housing 12 and a second end 86 located in the internal volume 40 of the housing 12. Second end 86 is spaced apart from the first end 84 of the first door 82 in the direction of the transverse axis 24 of the housing 12 and in the direction of the height axis 32 of the housing 12. The door unit 80 further includes a second door 90 having a first end 92 hingeably connected to the lower end 40 of the internal wall 36 of the housing 12 and a second edge 94 located in the internal volume 42 of the housing 12. Second end 94 is spaced apart from first end 92 of the second door 90 in the direction of the transverse axis 24 of the housing 12 and in the direction of the height axis 32 of the housing 12. Second door 90 is movable with respect to the first door 82 between a closed orientation shown in FIG. 4 with second end 94 of the second door 90 contacting second end 86 of the first door 82 and an open orientation indicated in FIG. 4 in dotted lines with the hinged movement being indicated in FIG. 4 by double-headed arrow 98. In the open orientation, the second end 86 of the first door 82 is spaced apart from the second end 94 of the second door 90 in the direction of the transverse axis 24 of the housing 12. A cigarette disposal path 100 is defined between the first door 82 and the second door 90 when the second door 90 is in the open orientation with the cigarette disposal path 100 being located above the drawer 50 when the drawer 50 is in the closed position.

A door-operating mechanism 102 is operatively connected to the second door 90 of the door unit 80 to move the second door 90 between the closed orientation and the open orientation thereof. The door-operating mechanism 102 including a button 104 located on the top wall 28 of the housing 12.

Figure 4:
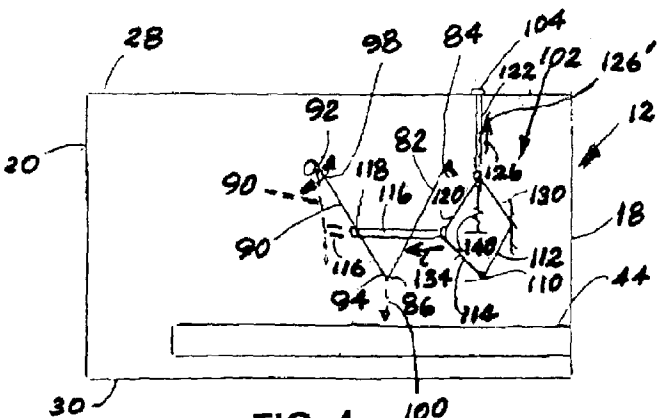
FIG. 4 is a schematic representation of an elevational view showing a mechanism for opening and closing the cigarette-accommodating doors of the ashtray of the present invention.

One form of door-operating mechanism is indicated in FIG. 4 as including a hinge 110 mounted on one of the walls of the housing. A first pivot lever arm 112 is hingeably connected at one end thereof to the hinge 110 and is connected at the other end thereof to one of the walls. A second pivot lever arm 114 is also hingeably connected at one end thereof to hinge 110 and has an arm 116 connected at one end thereof to the other end of pivot lever arm 114. A distal end 118 of arm 116 is hingeably connected to door 90. A third pivot lever arm 120 is hingeably connected at one end thereof to the arm 116 and has a second end connected to a distal end of an arm 122. A proximal end of arm 122 is connected to button 104 for movement therewith as indicated by double-headed arrow 126. A fourth pivot lever arm 130 is hingeably connected at one end thereof to the distal end of arm 122 for movement therewith. The other end of fourth pivot lever arm 130 is connected to the same wall as first pivot lever arm 112.

As can be understood from FIG. 4, forcing button 104 downward toward bottom wall 30 forces pivot lever arms 120 and 130 downward; however, pivot lever arms 112 and 114 cannot move downwardly, so the pivot lever arms tend to move in direction 134 thus moving arm 116 in direction 134, which moves door 90 away from door 82 to open the doors and define path 100. Spring 140 is connected at one end thereof to a wall of the housing 12 and at the other end thereof to the button arm 122. Spring 140 biases the button arm 122 in direction 126' which corresponds to the direction of closing the doors, or opposite to direction 134.

It is understood that while certain forms of the present invention have been illustrated and described herein, it is not to be limited to the specific forms or arrangements of parts described and shown.

What is claimed and desired to be covered by Letters Patent is:

1. An ashtray mechanism comprising:

a) a housing having a first side wall, a second side wall, a first end wall, a second end wall, a longitudinal axis extending between the first end wall and the second end wall, a transverse axis extending between the first side wall and the second side wall, a top wall, a bottom wall, a height dimension extending between the top wall and the bottom wall, disposal opening defined through the top wall, an internal wall having an upper rim attached to the top wall adjacent to the disposal opening and extending toward the bottom wall, the internal wall having a lower end spaced apart from the top wall and from the first side wall and from the second side wall and from the first end wall and from the second end wall and from the bottom wall, the housing having an internal volume defined by the top wall and the first side wall and the second side wall and the end wall and the second end wall and the bottom wall and a drawer slot defined in the first side wall;

b) a drawer slidably mounted on the first side wall of said housing to move between a closed position located beneath the disposal opening of said housing and an open position at least partially located outside of the internal volume of said housing;

c) a plurality of cigarette disposal openings defined through the top wall of said housing and located above said drawer when said drawer is in the closed position;

d) a cigarette grinder mechanism associated with one cigarette disposal opening of said plurality of cigarette disposal openings, said cigarette grinder mechanism including a motor mounted on said housing inside the internal volume of said housing, a power source located inside the internal volume of said housing, a switch mounted on the top wall of said housing, said switch having an "on" configuration and an "off" configuration and electrically connecting the motor to the power source when the switch is in the "on" configuration, said cigarette grinder mechanism further including a grinder blade connected to the motor and located adjacent to the one cigarette disposal opening to engage a cigarette located in the one cigarette disposal opening and to grind the cigarette located in the one cigarette disposal opening when the motor is electrically connected to the power source, said cigarette grinder mechanism further including a debris chute connecting the grinder blade to said drawer when said drawer is in the closed position;

e) a door unit attached to the top wall of said housing adjacent to the disposal opening in the top wall of said housing and including a first door having a first end hingeably connected to the lower end of the internal wall of said housing and a second end located in the internal volume of said housing and spaced apart from the first end of the first door in the direction of the transverse axis of said housing and in the direction of the height axis of said housing, said door unit further including a second door having a first end hingeably connected to the lower end of the internal wall of said housing and a second end located in the internal volume of said housing and spaced apart from the first end of the second door in the direction of the transverse axis of said housing and in the direction of the height axis of said housing, the second door being movable with respect to the first door between a closed orientation with the second end of the second door contacting the second end of the first door and an open orientation with the second end of the first door spaced apart from the second end of the second door in the direction of the transverse axis of said housing, a cigarette disposal path being defined between the first door and the second door when the second door is in the open orientation with the cigarette disposal path being located above said drawer when said drawer is in the closed position; and f) a door-operating mechanism operatively connected to the second door of said door unit to move the second door between the closed orientation and the open orientation thereof, said door-operating mechanism including a button located on the top wall of said housing.

2. An ashtray mechanism comprising:

a) a housing having a top wall having a cigarette disposal opening defined therein, a side wall and an internal volume defined between the top wall and the side wall;

b) a drawer slidably mounted on the side wall to move into and out of the internal volume of said housing, said drawer being in a closed position when said drawer is located inside the internal volume and being in an open position when at least some of said drawer is located outside of the internal volume;

c) a plurality of cigarette disposal openings defined through the top wall of said housing and located above said drawer when said drawer is in the closed position;

d) a door unit attached to the top wall of said housing adjacent to the cigarette disposal opening and including two doors which are movable relative to each other between an open orientation defining a cigarette disposal path between the cigarette disposal opening in the top wall of said housing and said drawer when said drawer is in the closed position; and e) a door-operating mechanism operatively connected to said door unit to move the doors of said door unit between the closed position and the open position, said door-operating mechanism including a button located on the top wall of said housing.

* * * * *